US006463914B2

(12) United States Patent
Augustin et al.

(10) Patent No.: US 6,463,914 B2
(45) Date of Patent: Oct. 15, 2002

(54) REGULATING MEMBER FOR CONTROLLING AN INTENSIFICATION OF PRESSURE OF FUEL FOR A FUEL INJECTOR

(75) Inventors: Ulrich Augustin, Kernen; Raimondo Giavi, Munich; Reda Rizk, Cologne, all of (DE)

(73) Assignee: Siemens Aktiengesellschaft AG, Munich (DE)

( * ) Notice: Subject to any disclaimer, the term of this patent is extended or adjusted under 35 U.S.C. 154(b) by 0 days.

(21) Appl. No.: 09/938,030

(22) Filed: Aug. 23, 2001

(65) Prior Publication Data

US 2002/0000219 A1 Jan. 3, 2002

Related U.S. Application Data

(63) Continuation of application No. PCT/DE00/00518, filed on Feb. 24, 2000.

(30) Foreign Application Priority Data

Feb. 24, 1999 (DE) ..... 199 07 952

(51) Int. Cl.[7] ..... F02M 37/04
(52) U.S. Cl. ..... 123/502; 123/467
(58) Field of Search ..... 123/502, 467, 123/447, 501, 472, 490, 498, 499; 239/88, 124

(56) References Cited

U.S. PATENT DOCUMENTS

| | | | | | |
|---|---|---|---|---|---|
| 3,943,901 | A | * | 3/1976 | Takahashi et al. | 123/502 |
| 3,961,612 | A | * | 6/1976 | Okamoto et al. | 123/502 |
| 4,069,800 | A | * | 1/1978 | Kanda et al. | 123/502 |
| 4,170,974 | A | | 10/1979 | Kopse et al. | 123/139 |
| 4,333,436 | A | | 6/1982 | Kopse et al. | 123/502 |
| 5,682,858 | A | | 11/1997 | Chen et al. | 123/446 |
| 5,779,149 | A | | 7/1998 | Hayes, Jr. | 239/124 |

FOREIGN PATENT DOCUMENTS

| | | |
|---|---|---|
| DE | 2954686 | 1/1980 |
| JP | 59141764 | 8/1984 |

* cited by examiner

*Primary Examiner*—Willis R. Wolfe
*Assistant Examiner*—Mahmoud Gimie
(74) *Attorney, Agent, or Firm*—BakerBotts LLP

(57) ABSTRACT

The regulating member according to the present invention is arranged in a pressure line in a fuel injector with a pressure intensifier and has an actuator, a valve chamber and a spring-loaded valve piston arranged moveably in the valve chamber. The valve piston, in its position of rest, makes a flow connection through the valve chamber between a pressure supply and a control space of the pressure intensifier and, in its switching position, the valve piston makes a flow connection through the valve chamber in which the control space in the pressure intensifier is relieved of pressure.

5 Claims, 2 Drawing Sheets

Figure 1:
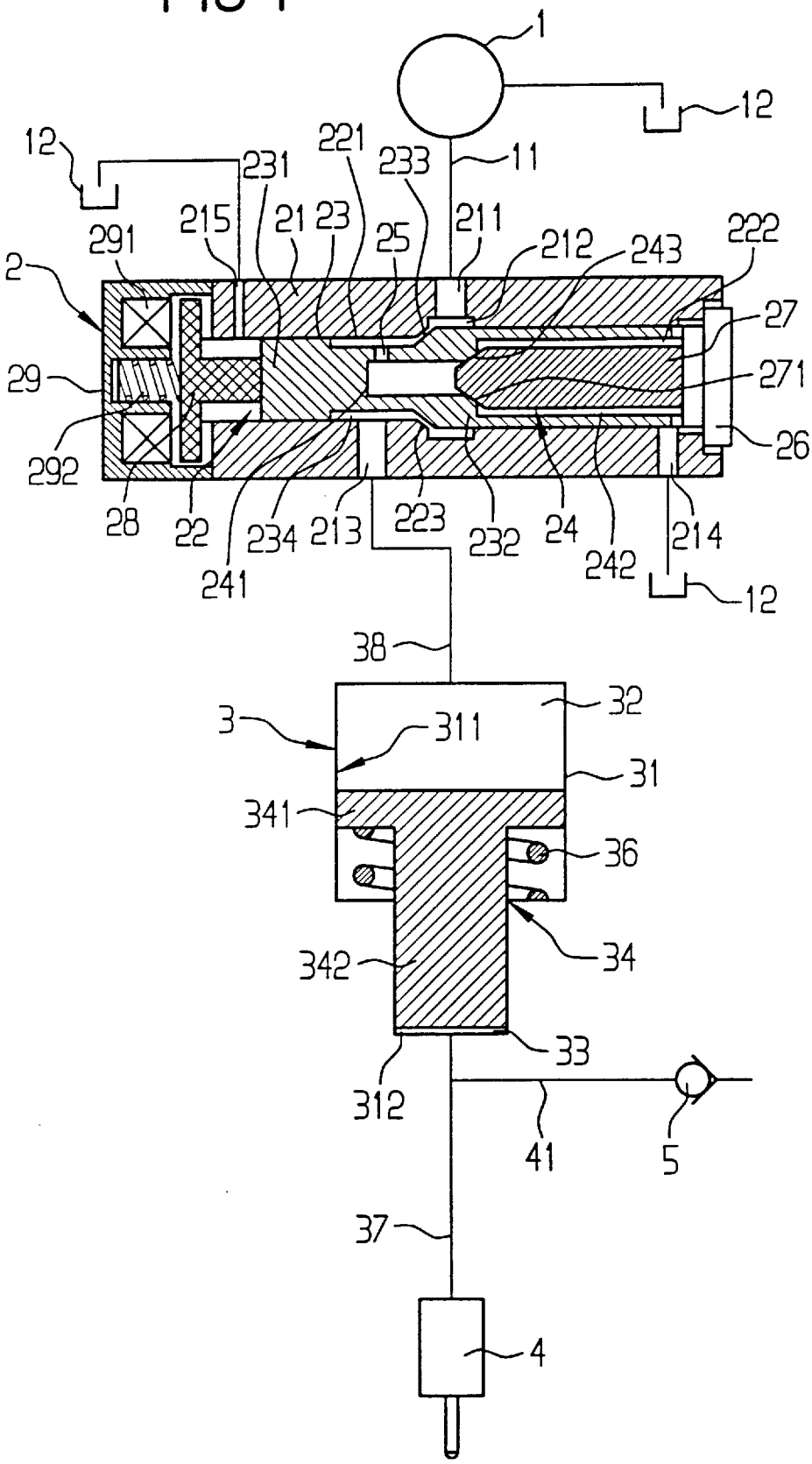

REGULATING MEMBER FOR CONTROLLING AN INTENSIFICATION OF PRESSURE OF FUEL FOR A FUEL INJECTOR

This is a continuation of copending application Ser. No. PCT/DE00/00518 filed Feb. 24. 2000. PCT Publication WO 00/50764, which claims the priority of DE 199 07 952.8 filed Feb. 24, 1999.

FIELD OF THE INVENTION

The invention relates to a regulating member for controlling an intensification of pressure of fuel for a fuel injector.

BACKGROUND OF THE INVENTION

In the supply of fuel to internal combustion engines, increasing use is made of injection systems which operate at very high injection pressures. Particularly where diesel engines are concerned, which are employed in the TRK sector. It has been found advantageous, in this context, to have accumulator injection systems which generate these high injection pressures by pressure intensification. One example of a fuel injector with pressure intensification is disclosed in U.S. Pat. No. 5,682,858. In this system, a pressure intensifier is arranged in the fuel injector, with a moveable piston which subdivides the pressure intensifier into a low-pressure-side control space and a high-pressure-side working space. The high-pressure-side working space of the pressure intensifier is connected to a fuel line in a fuel injector upstream of an injection nozzle. The low-pressure-side control space is connected to a pressure accumulator via an electromagnetically actuated regulating member formed in the fuel injector which is designed in such a way that, in the initial state, when it is not live, the regulating member breaks the flow connection between the pressure accumulator and the low-pressure-side control space of the pressure intensifier and keeps the control space pressureless. In this operating state, the working space of the pressure intensifier is filled with fuel via the fuel line.

By applying a current to the regulating member it is then switched in such a way that the flow connection between the pressure accumulator and the low-pressure-side control space of the pressure intensifier is opened and the piston in the pressure intensifier is acted upon on the control-space side by the pressure in the pressure accumulator. At the same time, the pressure which is established in the control space, being intensified by a multiple by the piston in the pressure intensifier, is transmitted to the fuel located in the working space of the pressure intensifier. Thereby the fuel, put under high pressure in the working space, has the effect, due to a connection between the working space and the injection nozzle, that the injection nozzle opens and fuel is injected into a combustion space of an internal combustion engine. As soon as the application of current to the regulating member is terminated, the regulating member returns to its initial state, with the result that the flow connection between the pressure accumulator and the control space is broken. The pressure on the fuel in the working space of the pressure intensifier then falls abruptly, the injection nozzle closes and injection is terminated.

In the accumulator injection system with pressure intensification, described in U.S. Pat. No. 5,682,858 A, therefore, the injected fuel quantity is determined by the time window for activating the actuator and by the design of the injection nozzle, that is to say by the fuel quantity injected per unit of time by the injection nozzle. Unavoidable manufacturing tolerances at the injection nozzle consequently result in the injected fuel quantity varying from fuel injector to fuel injector, which, particularly in the case of multicylinder engines, may lead to an uneven behavior of the engine, and in particular to true-running faults. Furthermore, in the known accumulator injector system with pressure intensification, the end of fuel injection into the combustion chamber and consequently the combustion profile depend on the accurate activation of the regulating member. Switching delays occurring during the activation of the regulating member may cause an undesirable lengthening of the injection time, which may be detrimental to the combustion values. Moreover, the regulating member illustrated in U.S. Pat. No. 5,682,858 A has a complicated construction, and consequently results in a high manufacturing outlay.

The object of the present invention is, therefore, to design a regulating member for controlling an intensification of pressure of fuel for a fuel injector in such a way that a simple and reliable regulating function is ensured and, in particular, wide spreads in the injection behavior of the fuel injectors are avoided.

SUMMARY OF THE INVENTION

The regulating member according to the present invention is arranged in a fuel injector, in a pressure line which connects a low-pressure-side control space of a pressure intensifier in the fuel injector to a pressure supply, and has an actuator, a valve chamber and a spring-loaded valve piston arranged moveably in the valve chamber. The valve piston, in its position of rest in which it is not actuated by the actuator, makes a flow connection through the valve chamber between an inflow orifice connected to the pressure supply and a first outflow orifice which is connected to the control space of the pressure intensifier. The switching position is brought about by the actuator with the valve piston in a position in which a flow connection is made through the valve chamber between the first outflow orifice, which is connected to the control space in the pressure intensifier, and a second outflow orifice which is kept pressureless.

In the regulating member according to the present invention, activation of the valve piston in the regulating member is necessary only for the start of injection by an injection nozzle in the fuel injector. However, the injection operation of the injection nozzle is terminated automatically, as soon as the entire fuel stored in a working space of the pressure intensifier is injected. The switching times in the regulating member therefore have no influence on the time at which injection is terminated. In the design of the regulating member according to the present invention, the automatic end of injection ensures a high degree of inherent safety in the event of possible operating faults of the regulating member. Moreover, the injection quantity is determined only by the fuel sucked in the combustion space of the pressure intensifier. Manufacturing tolerances of the injection nozzle in the fuel injector therefore have no influence on the metering of the injection quantity.

According to a preferred embodiment of the invention, the regulating member has two conically designed valve seats, on which the valve piston alternatively lies with one of its two conically designed sealing surfaces, depending on the switching state. This design of the regulating member with conical valve seats allows for simple manufacture and, furthermore, a high operating reliability of the regulating member.

According to a further preferred embodiment, the actuator is activated piezoelectrically, which result in high switching speeds, and therefore an improved efficiency of the regulating member.

DRAWINGS

Figure 2:
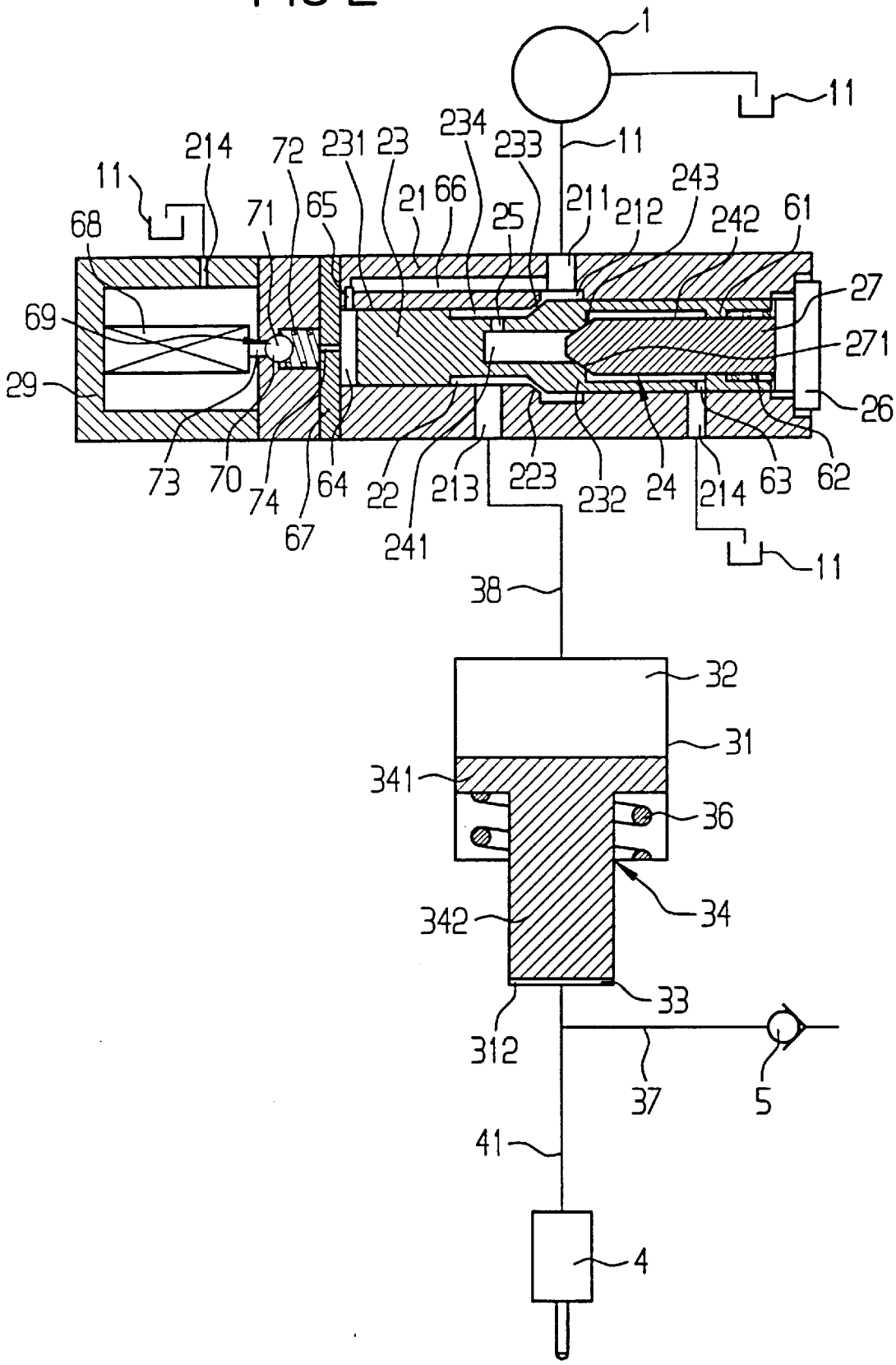

The present invention is explained in more detail below with reference to the drawings, in which:

FIG. 1 diagrammatically shows a first embodiment in cross section through a fuel injector with a regulating member according to the present invention; and FIG. 2 diagrammatically shows a second embodiment in cross section through a fuel injector with a regulating member according to the present invention.

DETAILED DESCRIPTION OF THE INVENTION

The fuel injector with pressure intensification, shown in FIGS. 1 and 2, is suitable, in particular, for use in diesel engines. The fuel injector comprises a regulating member 2 designed as a 3/2-way valve, of a pressure intensifier 3, of an injection nozzle 4 and of a nonretum valve 5, which are preferably arranged, jointly in a housing.

The pressure intensifier 3 in the fuel injector has a housing 31, in which a two-stage cylindrical inner bore is formed. The upper bore stage 311 which serves as a control space in the housing 31 of the pressure intensifier, possesses a larger diameter than the lower control bore 312 which serves as a working-space bore. Furthermore, a plunger 34 is arranged axially moveably in the inner bore of the housing 31 and is composed of a control piston 341 and of a working piston 342. The control piston 341 is in this case guided in the control-space bore 311 and is sealed off relative to the control-space bore 311. In a similar way to the control piston 341, the working piston 342 is guided in the working-space bore 312 and sealed off relative to the working-space bore 312.

Arranged around the working piston 342 is a compression spring 36 which, on one side, is supported against a step between the control-space bore 311 and the working-space bore 312 and, on the other side, bears against the control piston 341. Since the plunger 34 is made shorter than the inner bore of the housing 31, a control space 32 is formed between the end face of the control piston 341 and the housing 31 and a working space 33 is formed between the end face of the working piston 342 and the housing 31. The working space 33 is connected to a fuel feed line 37 and to an injection line 41, via which the injection nozzle 4 is connected to a fuel supply.

In the first embodiment of the present invention shown in FIG. 1, the regulating member 2, designed as a 3/2-way valve, having a housing 21, in which is provided a cylindrical valve chamber 22 which consists of a first bore portion 221 and a second bore portion 222, the second bore portion 222 having a larger inside diameter than the first bore portion 221. The valve chamber 22 has a beveled transitional region 223 between the first bore portion 221 and the second bore portion 222. An inflow orifice 211, a first outflow orifice 213, a second outflow orifice 214 and a leakage orifice 215 are incorporated in the housing 21 of the 3/2-way valve. In this case, the inflow orifice 211 opens in the region of the second bore portion 222 of the valve chamber 22, in the vicinity of the transitional region 223, in an annular groove 212 provided in the housing 21 and is also connected, via an inflow 11, to a pressure supply 1 which feeds-in a medium, preferably oil or fuel out of a reservoir 12, at a regulated pressure of about 200 bars. The first outflow orifice 213 opens in the first bore portion 221 of the valve chamber 22 and is connected to the control space 32 of the pressure intensifier 3 via a pressure line 38. The second outflow orifice 214 opens or issues into the valve chamber 22 in the region of an end portion of the second bore portion 222 and is connected to the reservoir 12, with the connection being designed to be pressureless.

Furthermore, a valve piston 23 is arranged in the valve chamber 22 of the 3/2-way valve and has a first cylindrical portion 231, which is guided in the first bore portion 221 of the valve chamber 22, and a second cylindrical portion 232, which is guided in the second bore portion 222 of the valve chamber 22. Between the first cylindrical portion 231 and the second cylindrical portion 232 of the valve piston 23 is a beveled transitional region 233, the inclination of which corresponds to the inclination of the transitional region 223 between the first bore portion 221 and the second bore portion 222 in the valve chamber 22.

The valve piston 23 has, in its first cylindrical portion 231, an annular groove 234 which extends as far as the transitional region 233 and which is located opposite the first outflow orifice 213. In the valve piston 23, a two-stage blind bore 24 is provided, in which an inner bore portion 241 has a smaller diameter than an outer bore portion 242 and a transitional region 243 is provided with a bevel between the bore portions. The inner bore portion 241 of the blind bore 24 is connected to the annular groove 234 around the valve piston 23 by means of a throttle bore 25 which extends through the first cylindrical portion 231 of the valve piston 23.

A cover 26 on the housing 21 of the 3/2-way valve 2 extends with a bolt 27 into the blind bore 24 in the valve piston 23, with a bolt tip 271 tapering conically. The cone inclination corresponds to the inclination of the transitional region 243 between the inner bore portion 241 and the outer bore portion 242 of the blind bore 24. The bolt 27 is in this case designed in such a way that an annular gap remains between its outer wall and the inner wall of the valve piston 23 in the outer bore portion 242 of the blind bore 24.

The valve piston 23, in its state of rest, sits with the transitional region 243 of the blind bore 24 on the bolt head 271, thus breaking the connection between the inner bore portion 241 and the outer bore portion 242 of the blind bore 24. With the valve piston 23 in this position, an annular gap is formed between the end face of the valve piston 23 and a stop on the cover 26. The annular gap makes a connection between the annular gap around the bolt 27 and the second outlet orifice 214.

The first cylindrical portion 231 of the valve piston 23 is provided with a plunger-shaped armature 28 which reaches into a head portion 29 arranged on the housing 21 and which is located opposite a magnet coil 291. The holding force of a compression spring 292, which is supported on the head portion 29, bears on the armature 28. The leakage orifice 215 also opens into this first cylindrical portion and is connected to the reservoir 12, the connection being kept pressureless.

FIG. 1 shows the 3/2-way valve 2 in its position of rest. In this position, the magnet coil 291 is dead, and, as a result of the holding force of the compression spring 292 bearing on the armature 28, the valve piston 23 is pressed with its transitional region 243, in the blind bore 24, onto the bolt head 271 of the bolt 27. With the valve piston 23 in this position, an annular gap is formed between the beveled transitional region 223 in the valve chamber 22 and the correspondingly beveled transitional region 233 on the valve piston 23, so that a flow connection is made between the inflow orifice 211 and the first outflow orifice 213 via the annular groove 212 and the annular gap between the transitional region 223 in the valve chamber 22 and the transitional region 233 on the valve piston 23 and the annular groove 234. By means of the 2/3-way valve 2, this flow connection makes it possible for a medium to pass out of the pressure supply 1 via the inflow 11, the 3/2-way valve 2 and the pressure line 38 into the control space 32 of the pressure intensifier 3. The force exerted by the pressurized medium in the control space 32 on the end face of the control piston 341 of the plunger 34 in the pressure intensifier 3 ensures that the plunger 34 is brought, counter to the holding force of the cup spring 36, into its maximum extended position, in which, as shown in FIG. 1, the working space 33 in the pressure intensifier 3 is reduced to its minimum volume.

The regulating member 2 shown in FIG. 1, designed as a 3/2-way valve, leads to the injection operation as described below. The pressure supply 1 ensures a regulated pressure of the medium, preferably in the region of about 200 bars. In the initial position, shown in FIG. 1, in which the magnet coil 291 in the 3/2-way valve 2 is not live, a flow connection through the 3/2-way valve between the pressure supply 1 and the control space 32 of the pressure intensifier 3 is open. The plunger 34 in the pressure intensifier 3 is in its extended position, in which the control-space volume is at a maximum, but the working-space volume is at a minimum. The injection operation is then prepared by current being applied to the magnet coil 291. The live magnet coil 291 pulls up the armature 28 counter to the holding force of the compression spring 292. The valve piston 23 connected to the armature 28 is thereby displaced out of its initial position, in which the transitional region 243 of the blind bore 24 sits on the bolt tip 271 in the direction of the head portion 29 into a position in which the transitional region 243 on the valve piston 23 butts against the transitional region 223 of the valve chamber 22. The flow connection from the inflow orifice 211 to the first outflow orifice 213 through the valve chamber 22 is thereby closed, so that the supply of the pressurized medium to the control space 32 in the pressure intensifier 3 is interrupted.

An annular gap opens simultaneously between the transitional region 243 in the blind bore 24 in the valve piston 23 and the bolt tip 271, so that a flow connection is made between the first outflow orifice 213 and the second outflow orifice 214 in the 3/2-way valve 2 via the annular groove 234, the throttle bore 25, the annular gap and the blind bore 24. Since the outflow 12 to the pressure supply, connected to the second outflow orifice 214, is kept pressureless, the pressure of the medium in the control space 32 of the pressure intensifier 3 falls abruptly and the compression spring 36 in the pressure intensifier 3 presses the control piston 341 back into the control space 32, so that the control space 32 empties and the medium flows back into the pressure supply 1 via the 3/2-way valve 2. Simultaneously with the control piston 341, however, the working piston 342 connected to the control piston is also drawn back and fuel is sucked into the working space 33 of the pressure intensifier 3 via the fuel feed line 37.

The time profile of the filling phase is determined, in this case, by the supply pressure prevailing in the fuel feed line 37, by the holding force of the compression spring 36 and by the flow velocity through the throttle bore 25. The filling phase of the working space 33 is terminated automatically as soon as the compression spring 36 has pushed the control piston 341 of the plunger 34 back into its position of rest and the control-space volume is minimized.

The start of injection into a combustion chamber of an internal combustion engine is defined by the interruption in the supply of current to the magnet coil 291. The compression spring 292 then pushes the armature 28 and consequently the valve piston 23 in the 3/2-way valve 2 back into their initial position, in which the transitional region 243 in the blind bore 24 sits on the bolt tip 271 and the flow connection between the first outflow orifice 213 and the second outflow orifice 214 is thus broken via the 3/2-way valve. Simultaneously, the transitional region 233 on the valve piston 23 lifts off from the transitional region 223 of the valve chamber 22 and the flow connection through the 3/2-way valve between the inflow orifice 211 and the first outflow orifice 213 opens. The pressure in the control space 32 of the pressure intensifier 3 then rises to the pressure of the medium prevailing in the pressure supply 1. This pressure of the medium, intensified by a multiple via the plunger 34, is transmitted to the fuel located in the working space 33. This fuel pressure, which is preferably in the region of above 1500 bars, is applied to the injection nozzle 4 via the injection line 41, the nonreturn valve 5 preventing a return flow of fuel.

The high fuel pressure in the injection line 41 has the effect that the injection nozzle 4 opens and fuel is injected into the combustion chamber of the internal combustion engine. During this injection operation, the control piston 341 of the plunger 34 is pressed away, counter to the holding force of the compression spring 36, by the pressure of the medium prevailing in the control space 32, so that the control space 32 is filled with medium. Simultaneously, the working piston 342 connected fixedly to the control piston 341 presses the fuel out of the working space 33 into the injection nozzle 4 and therefore into the combustion chamber of the internal combustion engine. As soon as the position, shown in FIG. 1, of the plunger 34 in the pressure intensifier 3 is reached and the entire fuel contained in the working space 33 is injected into the combustion chamber via the injection nozzle 4, the fuel pressure in the injection nozzle 4 falls and the injection nozzle 4 closes automatically, with the result that the injection operation is terminated.

FIG. 2 shows a second embodiment of the regulating member 3 designed as a 3/2-way valve, in which the actuator is driven piezoelectrically instead of electromagnetically. The use of a piezoelectric actuator ensures a higher switching speed of the 3/2-way valve, with the result that the injection profile of the injection nozzle can be controlled more effectively. The differences between the embodiments according to FIG. 1 and FIG. 2 are described briefly below, with identical components being given the same reference symbols.

In the 3/2-way valve 2 illustrated in FIG. 2, the valve piston 23 has, in the region of the blind bore 24, an additional shoulder 61 on which the compression spring 292 is supported. This compression spring 292 is arranged around the bolt 27 and butts with its other end on the cover 26. Upstream of the shoulder 61, in the valve piston 23, is a passage bore 63 which connects the blind bore 24 in the valve piston 23 to the second outflow orifice 214 in any position of the valve piston 23.

The valve chamber 22 has additionally, upstream of the first cylindrical portion 231 of the valve piston 23, a control space 64 which is connected to the inflow orifice 211 via a throttle bore 65 and a side channel 66. The control space 64 in the valve chamber 22 is separated by an intermediate component 67 from the head portion 29 in which a piezoelectric actuator 68 is arranged.

The intermediate component 67 has extending through it a bore 69, in which is formed a valve seat 70, on which a valve ball 71, loaded by a spring 72, sits. Furthermore, the valve ball 71 is connected to the piezoelectric actuator 68 via a tappet 73 which is arranged in the bore 69. Moreover, the bore 69 has a throttle point 74 in the portion adjacent to the control space 64. Also provided in the head portion 29 containing the piezoelectric actuator 68 is the leakage orifice 215 which is connected to the reservoir 12 and kept pressureless.

FIG. 2 shows the initial position of the 3/2-way valve 2, with the piezoelectric actuator 68 not activated. In this initial position, the valve ball 71 sits on the leakage orifice 215 via the bore 69 and the head portion 29 is closed. The medium which is located in the control space 64, and which is fed out of the pressure supply 1 via the inflow 11, the inflow orifice 211, the side channel 66 and the throttle bore 65, then acts upon the end face of the valve piston 23. The pressure of the medium is set in the pressure supply 1, with the result that the valve piston 23 is brought, counter to the holding force of the compression spring 62, into a position in which the transitional portion 243 in the blind bore 24 sits on the bolt tip 271, whereby an annular gap is formed between the transitional region 223 of the valve chamber 22 and the transitional region 233 of the valve piston 23. In this position, medium can flow out of the pressure supply 1 into the control space 32 of the pressure intensifier 3 via the 3/2-way valve 2, with the result that the plunger 34 of the pressure intensifier 3 is pressed into the maximum extended position shown in FIG. 2.

With current being applied to the piezoelectric actuator 68, the latter, by virtue of its elongation, pushes the valve ball 71 from the valve seat 70 with the aid of the tappet 73, thus making a flow connection from the control space 64 to the leakage orifice 215 via the bore 69. Medium can then flow out of the control space 64 via this flow connection, with the result that the pressure in the control space 64 falls. Consequently, the compression spring 292 presses the valve piston 23 out of the position shown in FIG. 2 in the direction of the intermediate component 67, the transitional region 243 of the blind bore 24 in the valve piston 23 lifting off from the bolt head 271 and a flow connection opening from the control space 32 of the pressure intensifier 3 back to the pressure supply 1 via the 3/2-way valve. Simultaneously, the transitional region 233 of the valve piston 23 sits on the transitional region 223 of the valve chamber 22, so that the flow connection between the pressure supply 1 and the control space 32 of the pressure intensifier 3 is broken via the 3/2-way valve.

The 3/2-way valve shown in FIG. 2 triggers the same injection operation of the injection nozzle 4 as is illustrated in connection with the 3/2-way valve shown in FIG. 1. However, as compared with the electromagnetic drive shown in FIG. 1, quicker switching times can be achieved with the embodiment shown in FIG. 2, in which the piezoelectric actuator 68 is used as a drive. Furthermore, the two throttle points 65, 74 in the inflow and outflow to the control space 64 ensure a braked throughflow and therefore an improved valve flight phase.

The regulating member 2 according to the invention has, fundamentally, the advantage that, when such a regulating member is used in an accumulator injection system, the injected fuel quantity is determined solely by the time-related design of the filling phase of the pressure intensifier 3 with fuel. The unavoidable manufacturing tolerances of the injection nozzle 4 therefore have no effect on the metering of the injection quantity. Furthermore, the complete emptying of fuel from the pressure intensifier 3 during injection ensures an automatic end of injection, irrespective of the switching speed of the regulating member 2. This sharp end of injection ensures good combustion values of the internal combustion engine. Moreover, the design of the regulating member 2 with two conical valve seats allows for simple manufacture and high operating reliability of the regulating member.

We claim:

1. A regulating member for controlling the intensification of pressure of fuel for a fuel injector comprising a pressure intensifier having a low-pressure-side control space and a high-pressure-side working space, the control space being connected via a pressure line to a pressure supply which contains a pressurized medium, and the working space being connected to a fuel injection line, wherein the regulating member is arranged in the pressure line between the pressure supply and the control space of the pressure intensifier, and further comprising an actuator, an inflow orifice which is connected to the pressure supply, a first outflow orifice which is connected to the pressure intensifier, a second outflow orifice which is kept pressureless, and a spring-loaded valve piston arranged moveably in a valve chamber, the valve piston is operatively connected to the actuator so as to be switched between a position in which a flow connection is made in the valve chamber between the inflow orifice and the first outflow orifice, and a position in which a flow connection is made in the valve chamber between the first outflow orifice and the second outflow orifice, further wherein the spring-loaded valve piston is in its position of rest in which it is not actuated by the actuator, a flow connection is made in the valve chamber between the inflow orifice and the first outflow orifice, and, when in the switching position triggered by the actuator is in the position in which a flow connection is made in the valve chamber between the first outflow orifice and the second outflow orifice; and still further comprising a housing in which a first conical valve seat and a second conical valve seat is formed, and wherein the valve piston has a first conical sealing surface and a second conical sealing surface, whereby the valve piston, when in its position of rest, sits with its first conical sealing surface on the first conical valve seat, and when the valve piston is in its switching position, sits with its second conical sealing surface on the second conical valve seat.

2. The regulating member according to claim 1, wherein the housing has as a valve chamber having a two-stage cylindrical inner bore in which the first conical valve seat is formed in a stepped transitional region of the bore, the housing further comprising a cover which projects into the valve chamber and on which the second conical valve seat is formed, and further wherein the valve piston having a two-stage cylindrical outer shape in which the first conical sealing surface is formed in a stepped transitional region, and the valve piston also having a blind bore, in which the second conical sealing surface is formed.

3. The regulating member according to claim 1, further comprising a throttle provided in the flow connection between the first outflow orifice and the second outflow orifice.

4. The regulating member according to claim 1, wherein the actuator is an electromagnetically controlled actuator which has a magnet coil which exerts a magnetic force on an armature attached to the valve piston.

5. The regulating member according to claim 1, wherein the actuator is a piezoelectric actuator which can actuate a valve which controls the pressure of a fuel on the valve piston in a control space.

* * * * *